US008777096B1

(12) United States Patent
Rodney et al.

(10) Patent No.: US 8,777,096 B1
(45) Date of Patent: Jul. 15, 2014

(54) CARDBOARD DESK ORGANIZER

(71) Applicants: Sandra Brian Rodney, Alpharetta, GA (US); Glenn Brian Rodney, Alpharetta, GA (US)

(72) Inventors: Sandra Brian Rodney, Alpharetta, GA (US); Glenn Brian Rodney, Alpharetta, GA (US)

( * ) Notice: Subject to any disclaimer, the term of this patent is extended or adjusted under 35 U.S.C. 154(b) by 0 days.

(21) Appl. No.: 13/844,696

(22) Filed: Mar. 15, 2013

(51) Int. Cl.
*B65D 5/495* (2006.01)
*B65D 5/498* (2006.01)

(52) U.S. Cl.
USPC ..... 229/120.34; 211/184; 229/120.36; 229/178

(58) Field of Classification Search
USPC ..... 229/120.24, 120.25, 120.34, 120.36, 229/120.38, 178, 913; 220/532, 533, 552; 211/184
See application file for complete search history.

(56) References Cited

U.S. PATENT DOCUMENTS 973,429 A * 10/1910 Hilliker ..... 229/120.34
2,647,679 A * 8/1953 Schilling et al. ..... 229/120.36
2,749,014 A * 6/1956 Russell et al. ..... 229/120.36
2,914,235 A * 11/1959 Jones ..... 229/120.34
4,308,953 A * 1/1982 Cohen ..... 220/533
4,429,932 A * 2/1984 Brennan ..... 229/120.36
4,437,713 A * 3/1984 Roach ..... 229/178
4,899,928 A * 2/1990 Korff ..... 229/120.36
4,938,415 A * 7/1990 Walker et al. ..... 229/178
5,143,431 A * 9/1992 Udell ..... 229/120.24
5,282,567 A * 2/1994 Dickson ..... 229/120.36
6,493,917 B1 * 12/2002 Sunka ..... 220/552

* cited by examiner

*Primary Examiner* — Gary Elkins

(57) ABSTRACT

A foldable cardboard desk organizer made of corrugated cardboard for use in standard elementary school desks. The desk organizer includes a base to which are attached a front wall, a back wall and two side walls. The walls are formed by folding the wall elements upon themselves and securing by a tab and slot system to create strong, two-layer walls. The wall elements further include wing portions that, when assembled, overlap and link separate wall elements together to provide structure and support for the desk organizer. One or more divider sections may be installed within the base by attaching them to the walls to create two or more compartments within the base and defined by the divider sections. The divider sections include three overlapping layers for increased strength.

20 Claims, 4 Drawing Sheets

CARDBOARD DESK ORGANIZER

BACKGROUND OF THE INVENTION

The traditional elementary school desk includes four legs and a fixed desktop with an open shelf or book box underneath. This design has been standard for decades due to its simplicity and ruggedness. However, the book box generally includes a single, open-fronted shelf for students to store their books and supplies. Without a proper way to organize available to them, many children's school desks rapidly become incredibly disorganized and messy.

SUMMARY OF THE INVENTION

Therefore, it is an object of the present invention to provide a device to assist students in organizing their schoolbooks and supplies suitable for use in a standard elementary school desk.

It is a further object of the present invention to provide a desk organizer that is sturdy enough for use by school age children, yet inexpensive enough to be widely available.

To attain the above objects, according to an aspect of the invention, there is provided a foldable cardboard desk organizer including a base having a straight front edge, a straight back edge, and a pair of straight side edges. The desk organizer also has a front wall including a first edge and a second edge extending in a spaced and parallel relationship to the first edge, wherein the front wall is connected to the base by a fold line along the front edge. The front edge includes a plurality of linear slots along the front edge, and the front wall includes an outer front wall and an inner front wall. The inner and outer front walls are connected by a fold line that bisects the front wall lengthwise. The inner front wall includes a slot extending perpendicularly from the second edge and a plurality of tabs extending from the second edge, wherein the tabs engage with the slots along the front edge when the front wall is folded along the fold line. The desk organizer further includes a back wall having a first edge and a second edge extending in a spaced and parallel relationship to the first edge. The back wall is connected to the base by a fold line along the back edge and the back edge includes a plurality of linear slots along the back edge. The back wall includes an outer back wall and an inner back wall, wherein the inner and outer back walls are connected by a fold line that bisects the back wall lengthwise. The inner back wall includes a slot extending perpendicularly from the second edge and a plurality of tabs extending from the second edge, wherein the tabs engage with the slots along the back edge when the back wall is folded along the fold line. The back wall further includes two wing portions that extend from opposite ends of the outer back wall and are connected to the outer back wall by a fold line. The desk organizer further includes a pair of side walls, each having a first edge and a second edge extending in a spaced and parallel relationship to the first edge. Each of the side walls are connected to the base by a fold line along the side edge and the side edge comprises a plurality of linear slots along the side edge. Each side wall includes an outer side wall and an inner side wall, wherein the inner and outer side walls are connected by a fold line that bisects each of the side walls lengthwise. The inner side wall includes a plurality of tabs extending from the second edge, wherein the tabs engage with the slots along the side edge when the side walls are folded along the fold lines. The outer side walls further include a wing portion that extends from the end of the outer side walls adjacent to the front edge, wherein the wing portions are connected to the outer side walls by fold lines. The desk organizer also includes a first divider section having three equal sections, wherein a first section is connected by a fold line with a second section and the second section is connected by a fold line with a third section. The first section and second section each comprise two wing portions extending from opposite ends of the respective sections and are connected to the respective sections by fold lines. The first divider section further includes a first slot that extends from the first section to the second section perpendicular to the fold line and a second slot that extends perpendicularly into the third section from an outer edge of the third section. The desk organizer further includes a second divider section having three equal sections, wherein a first section is connected by a fold line with a second section and the second section is connected by a fold line with a third section. The second section and third section each include two wing portions extending from opposite ends of the respective sections and are connected to the respective sections by fold lines. The second divider section further includes a first slot that extends from the first section to the second section perpendicular to the fold line and a second slot that extends perpendicularly into the third section from an outer edge of the third section.

In a feature, the base has a rectangular shape and is sized to fit within the book box of a standard elementary school desk.

In another feature, the first edge of the front wall is common with the front edge of the base, the first edge of the back wall is common with the back edge of the base, the first edges of the sidewalls are common with the side edges of the base.

In a further feature, the slot in inner front wall is located at the midpoint of the second edge of the front wall.

In a still further feature, the fold lines that connect the two wing portions to the outer back wall are adjacent and collinear with the side edges of the base.

In a feature, the wing portions connected to the outer back wall have the same width as the outer back wall.

In another feature, the wing portions connected to the outer back wall start with the same width as the outer back wall and taper slightly.

In yet another feature, the second edge of the side walls is shorter than the first edge and terminates before the front edge of the base.

Preferably, the plurality of linear slots along the side edge include a smaller slot toward the front edge of the base, and the inner side wall further includes an angled cut-out that initially forms a right angle with the second edge then angles toward the front edge of the base.

More preferably, the outer side walls further include a second wing portion having a pentagonal shape in which a first side of the second wing portion is substantially parallel and adjacent to the wing portion of the outer side wall and an adjacent second side of the second wing portion forms the connection with the outer side wall by a fold line formed at an angle with respect to the side edge.

Still more preferably, an adjacent third side of the second wing portion includes a tab, wherein when the second wing portion is folded along the fold line the tab engages the smaller slot along the side edge of the base.

In a feature, the fold lines that connect the wing portions to the outer side walls are adjacent and collinear with the front edge of the base.

In another feature, the wing portions connected to the outer side walls have a width that is less than or equal to the width of the outer front wall of the front wall, In a further feature, each of the sections of the first divider section have a length equal to the length of the side walls and a width equal to the width of the outer front wall, and each of the sections of the second divider section have a length equal to the length of the front and back walls and a width equal to the width of the outer front wall.

In a still further feature, the first slot in the first divider section has a length equal the width of the first section and extends equally into either section with the fold line between the first and second sections defining the midpoint of the first slot.

In a feature, the first slot and the second slot of the first divider section are collinear and situated are equidistant from the fold lines connecting the wing portions.

In another feature, the first slot in the second divider section has a length equal the width of the first section and extends equally into either section with the fold line between the second and third sections defining the midpoint of the first slot.

In yet another feature, the first slot and the second slot of the second divider section are collinear and situated are equidistant from the fold lines connecting the wing portions.

In a further feature, the slot on the back wall and the slot on the front wall are sized to receive the wing portions of the first and second sections of the first divider section.

These and other exemplary features and advantages of the present invention will become clear from the following description with reference to the accompanying drawings.

BRIEF DESCRIPTION OF THE DRAWINGS

The foregoing and other exemplary purposes, aspects and advantages will be better understood from the following detailed description of an exemplary embodiment of the invention with reference to the drawings, in which.

DETAILED DESCRIPTION OF THE INVENTION

Figure 1:
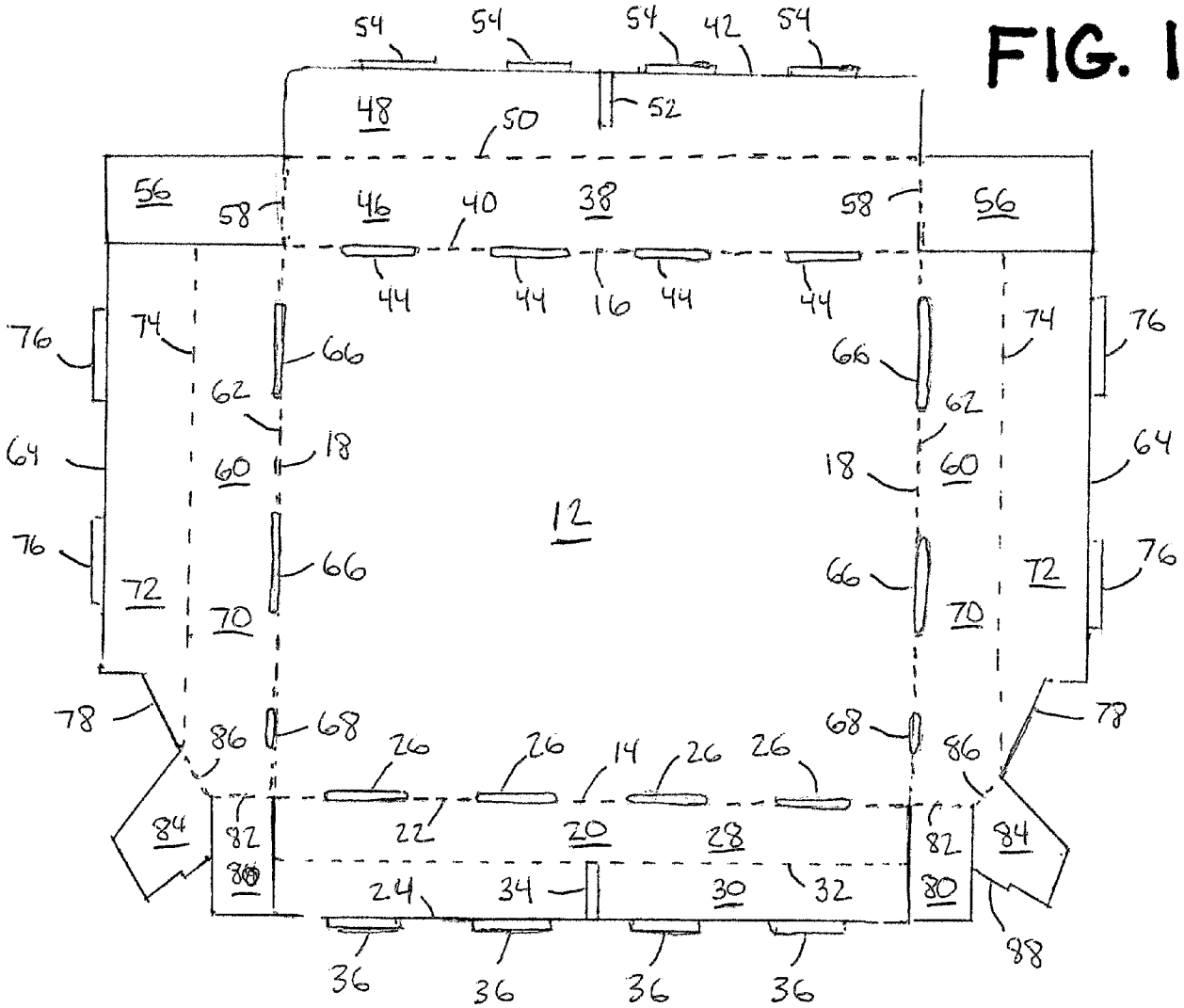
FIG. 1 shows a schematic of an exemplary embodiment of the foldable cardboard desk organizer constructed from corrugated cardboard in a flat unfolded condition.

Referring now to the drawings, and more particularly to FIGS. 1-4, there are shown exemplary embodiments of the system according to the present invention.

Figure 4:
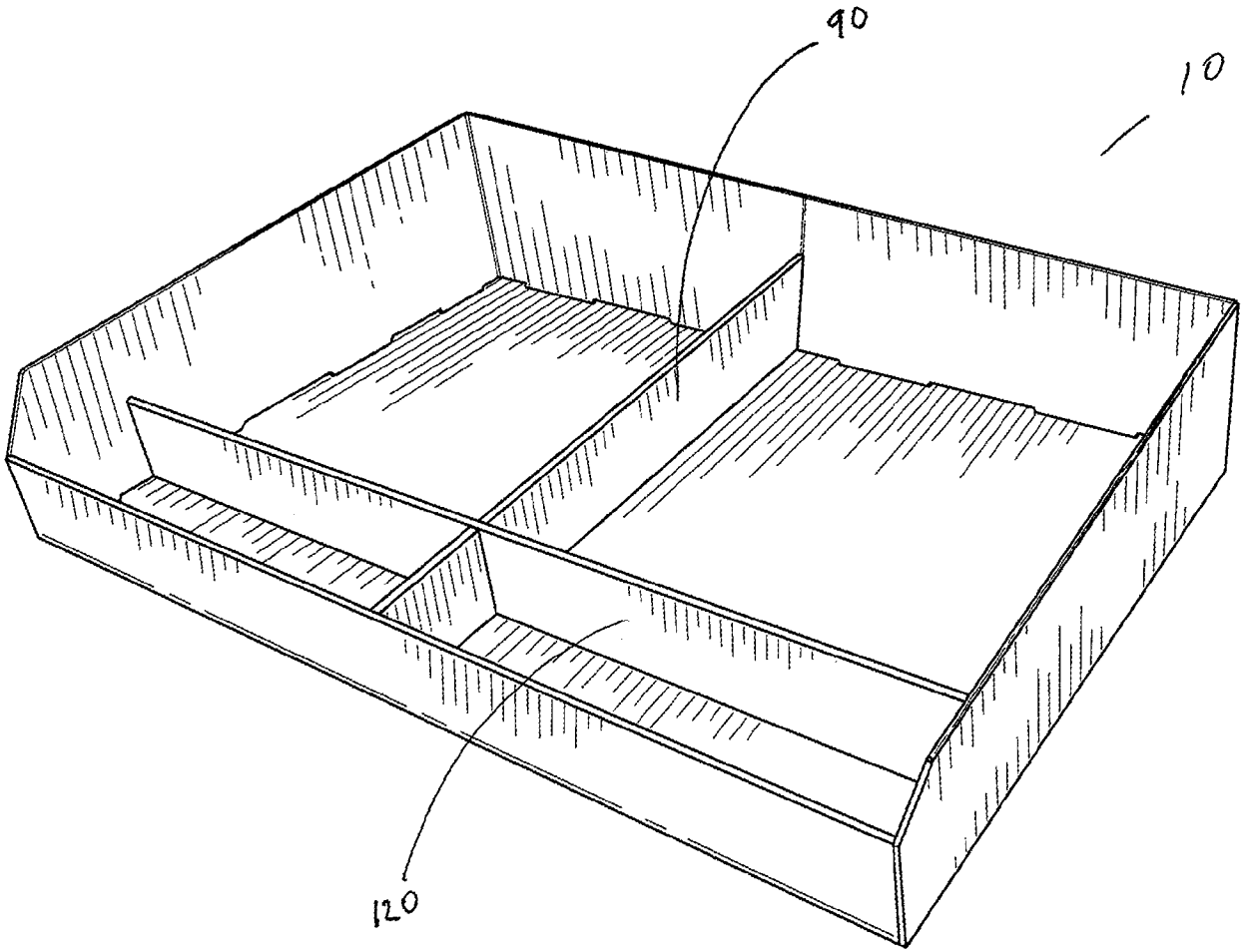
FIG. 4 shows a perspective view of the assembled desk organizer.

FIG. 1 shows an embodiment of the foldable cardboard desk organizer constructed from corrugated cardboard in accordance with the invention. The desk organizer is indicated generally by 10 and is illustrated in a flat unfolded condition prior to folding thereof as shown in FIG. 4 to provide a desk organizer for a standard school desk with an open book box.

With reference to FIG. 1, the desk organizer 10 of the invention includes a base 12 having a rectangular shape including a straight front edge 14, a straight back edge 16, and a pair of straight side edges 18. The base 12 is preferably sized to fit within the book box of a standard elementary school desk. However, it should be recognized that the desk organizer 10 may be realized in many different sizes. For example, the desk organizer 10 may be sized to occupy a smaller footprint within an elementary school desk, such as half the width of the book box.

The desk organizer 10 includes a front wall 20 having a first edge 22, which is common with the front edge 14 of the base 12, and a second edge 24 extending in a spaced and parallel relationship to the first edge 22. The front wall 20 is connected to the base 12 by a fold line along the front edge 14 of the base 12. The front edge 14 of the base 12 further includes a series of linear slots 26 evenly spaced along the front edge 14. The front wall 20 includes an outer front wall 28 and an inner front wall 30. The inner and outer front walls 28,30 are connected by a fold line 32 that bisects lengthwise the front wall 20. The inner front wall 30 includes a slot extending perpendicularly from the second edge 24 of the front wall 20. The inner front wall 30 further includes a series of tabs 36 situated on and extending from the second edge 24. The tabs 36 are located such that when the front wall 20 is folded along the fold line 32, the tabs 36 engage with the slots 26 along the front edge 14 of the base 12.

The desk organizer 10 further includes a back wall 38 having a first edge 40, which is common with the back edge 16 of the base 12, and a second edge 42 extending in a spaced and parallel relationship to the first edge 40. The back wall 38 is connected to the base 12 by a fold line along the back edge 16 of the base 12. The back edge 16 of the base 12 further includes a series of linear slots 44 evenly spaced along the back edge 16. The back wall 38 includes an outer back wall 46 and an inner back wall 48. The inner and outer back walls 46,48 are connected by a fold line 50 that bisects lengthwise the back wall 38. The inner back wall 48 includes a slot 52 extending perpendicularly from the second edge 42 of the back wall 38 and a series of tabs 54 situated on and extending from the second edge 42. The tabs 54 are located such that when the back wall 38 is folded along the fold line 50, the tabs 54 engage with the slots 44 along the back edge 16 of the base 12. The back wall 38 further includes two wing portions 56 that extend from opposite ends of the outer back wall 46 and are connected to the outer back wall 46 by a fold line 58, which is adjacent and collinear with the side edges 18 of the base 12. The wing portions 56 are preferably the same width as the outer back wall 46 or start as the same width as the outer back wall 56 and taper slightly.

The desk organizer 10 further includes a pair of side walls 60, each having a first edge 62, which is common with the side edge 18 of the base 12, and a second edge 64 extending in a spaced and parallel relationship to the first edge 62. Preferably, the second edge 64 is of shorter length than the first edge 62 terminating before the front edge 14 of the base 12. Each of the side walls 60 are connected to the base 12 by a fold line along the side edge 18 of the base 12. The side edge 18 of the base 12 further includes a series of linear slots 66 spaced along the side edge 18. Preferably, the linear slots 66 include a smaller slot 68 toward the front edge 14 of the base 12.

Each side wall 60 includes an outer side wall 70 and an inner side wall 72. The inner and outer side walls 70,72 are connected by a fold line 74 that bisects lengthwise each of the side walls 60. The inner side wall 70 includes a series of tabs 76 situated on and extending from the second edge 64. The tabs 76 are located such that when the side wall 60 is folded along the fold line 74, the tabs 76 engage with the slots 66 along the side edge 18 of the base 12. The inner side wall 72 further includes an angled cut-out 78 initially forming a right angle with the second edge 64, then angled toward the front edge 14 of the base 12. The outer side wall 70 includes a wing portion 80 that extends from the end of the outer side wall 70 adjacent to the front edge 14 of the base 12. The wing portion 80 is connected to the outer side wall 70 by a fold line 82, which is adjacent and collinear with the front edge 14 of the base 12. The wing portion 80 preferably has a width that is less than or equal to the width of the outer front wall 28 of the front wall 20, or starts with the same width as the outer front wall 28 and tapers slightly.

The outer side wall 70 further includes a second wing portion 84. The second wing portion 84 has a pentagonal shape in which a first side of the second wing portion 84 is substantially parallel and adjacent to the wing portion 80 and an adjacent second side of the second wing portion 84 forms the connection with the outer side wall 70. In this manner, the second wing portion 84 is connected to the outer side wall 70 by a fold line 86 formed at an angle with respect to the side edge 18. An adjacent third side of the second wing portion 84 includes a tab 86, which when the second wing portion 84 is folded along the fold line 86 engages the smaller slot 68 along the side edge 18 of the base 12.

The side walls 60 and back wall 38 have a uniform height defined to be less than the standard height of the opening of a book box of an elementary school desk. The front wall 20 is shorter in height than the other walls to permit visibility and access to the desk organizer 10 from the front of the book box, as well as a surface for the desk organizer 10 to be grasped. Additionally, the angled portion of the side walls 60 defined by the fold line 86 that connects the second wing portion 84 improves the aesthetics, safety and durability of the desk organizer.

Preferably, the side walls 60 and back wall 38 have a height of approximately 3.5 inches and the front wall 20 has a height of approximately 2 inches. Such back wall 38 height allows the desk organizer 10 to tilt down when pulled out of the desk box by a child. As the desk organizer 10 is let go when removed half way from the book box, the desk organizer 10 then tilts down, but the back wall 38 contacts the lower surface of the desk top to create a wedge in the book box. This prevents the desk organizer 10 from falling out. Additionally, such a height for the back wall 38 creates the maximum angle/tilt to permit access to the desk organizer 10 within the book box, while reducing the amount of disturbance to the contents in the desk organizer 10.

Preferably, the side walls 60 are constructed in a manner such that they taper away from the base 12. For example, when assembled, the side walls 60 may be angled away from the base by approximately 5 to 8 degrees from vertical. The back wall 38 may also be optionally tapered in a similar manner. By tapering the side walls 60 and back wall 38 in this manner, the assembled desk organizers 10 may be easily nested and stacked upon one another to accommodate and facilitate the stacking of the desk organizers 10 for storage or delivery.

Figure 2:
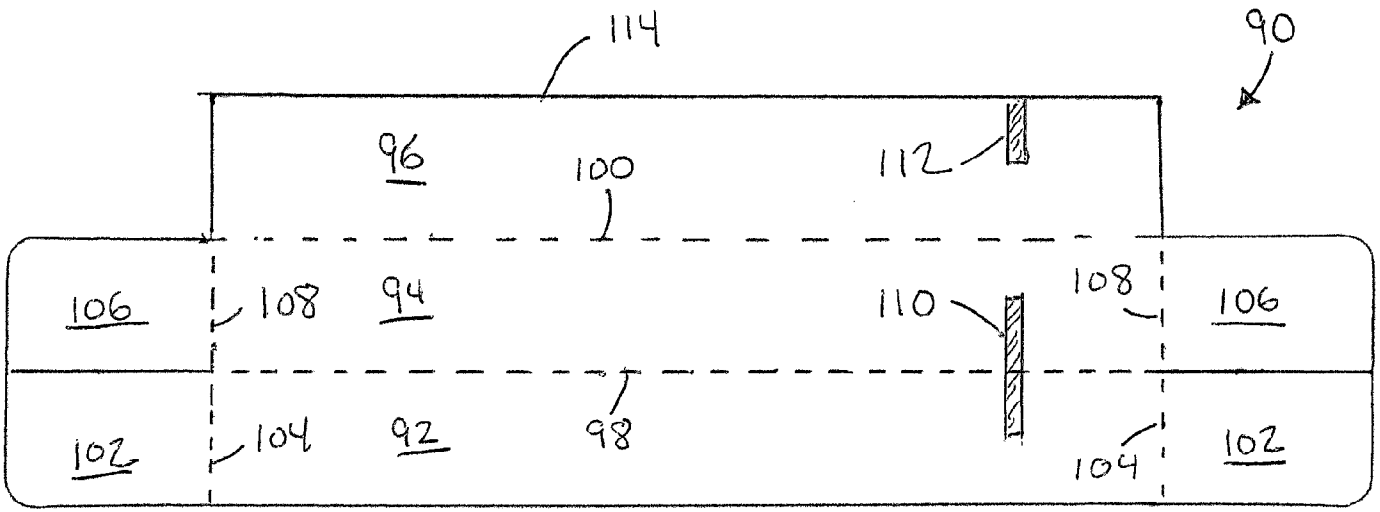
FIG. 2 shows a schematic of a first divider section of the desk organizer illustrated in a flat unfolded condition.
Figure 3:
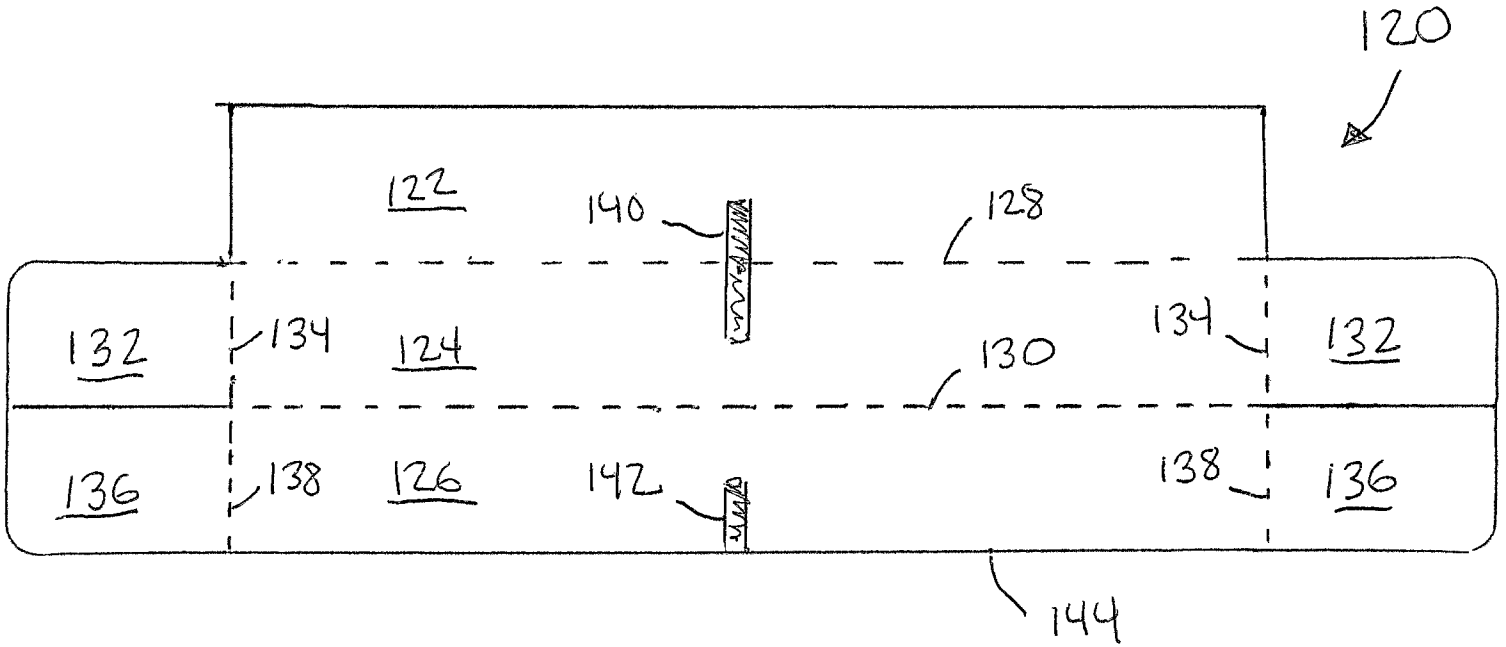
FIG. 3 shows a schematic of a second divider section of the desk organizer in a flat unfolded condition.

With reference to FIGS. 2 and 3, there are shown two divider sections 90,120 of the desk organizer 10 in accordance with the invention. The divider sections 90,120 are illustrated in a flat unfolded condition prior to folding thereof.

FIG. 2 shows a first divider section 90 constructed from corrugated cardboard that provides a separation within the desk organizer between and parallel to the side walls 60. The first divider section 90 includes three equal rectangular sections 92,94,96, each having a length substantially similar to the length of the side walls 60 and a width substantially similar to the width of the outer front wall 20. A first section 92 is connected by a fold line 98 with a second section 94, while the second section 94 is connected by a fold line 100 with the third section 96. The first section 92 further includes two wing portions 102 extending from opposite ends of the first sections 92. The wing portions 102 are connected to the first section 92 by fold lines 104. Similarly, the second section 94 includes two wing sections 106 extending from either end of the second section 94. The wing portions 102,106 are preferably the same width as their respective sections 92,94 or start as the same width as their respective sections 92,94 and taper slightly.

The first divider section 90 further includes a slot 110 that extends from the first section 92 to the second section 94 perpendicular to the fold line 98. Preferably, the slot 110 has a length substantially equal the width of the first and second sections 92,94, and extends equally into either section 92,94 with the fold line 98 defining the midpoint of the slot 110. The third section 96 includes a second slot 112 extending perpendicularly into the third section 96 from an outer edge 114 of the third section 96. The first slot 110 and the second slot 112 are collinear and are each situated at an equal distance from the fold lines 104,108. The distance may be selected to comport with the desired dimensions of any resultant divisions within the desk organizer 10.

FIG. 3 shows a second divider section 120 constructed from corrugated cardboard that provides a separation within the desk organizer between and parallel to the front wall 20 and the back wall 38, and therefore perpendicular to the first divider section 90. The second divider section 120 also includes three equal rectangular sections 122,124,126, each having a length substantially similar to the length of the front and back walls 20,38, and a width substantially similar to the width of the outer front wall 20. A first section 122 is connected by a fold line 128 with a second section 124, while the second section 124 is connected by a fold line 130 with the third section 126. The second section 124 further includes two wing portions 132 extending from opposite ends of the second section 124. The wing portions 132 are connected to the second section 124 by fold lines 134. Similarly, the third section 126 includes two wing sections 136 extending from either end of the third section 126. The wing portions 132,136 are preferably the same width as their respective sections 124,126 or start as the same width as their respective sections 124,126 and taper slightly.

The second divider section 120 further includes a slot 140 that extends from the first section 122 to the second section 124 perpendicular to the fold line 128. Preferably, the slot 140 has a length substantially equal the width of the first and second sections 122,124, and extends equally into either section 122,124 with the fold line 128 defining the midpoint of the slot 140. The third section 126 includes a second slot 142 extending perpendicularly into the third section 126 from an outer edge 144 of the third section 126. The first slot 140 and the second slot 142 are collinear and are each situated at an equal distance from the fold lines 134,138. The distance may be selected to comport with the desired dimensions of any resultant divisions within the desk organizer 10.

FIG. 4 shows a perspective view of the completed desk organizer 10 formed by folding and combining the desk organizer 10 and the divider elements 90,120. To achieve the desk organizer 10, the unfolded elements 10,90,120 must be properly folded and assembled to construct the desk organizer 10.

First, the back wall 38 is folded ninety degrees to vertical along the fold line 40, and the inner back wall 48 is folded 180 degrees along the fold line 50 toward the front edge 14 of the base 12 and over the outer back wall 46, such that the tabs 54 on the second edge 42 of the back wall 38 engage with the slots 44 on the back edge 16 of the base. This creates a secure two-layer back wall 38 roughly perpendicular with the base 12. The wing portions 56 are then folded ninety degrees along fold lines 58 toward the front edge 14 of the base 12.

The side walls 38 are then constructed by folding the side walls 60 ninety degrees to vertical with respect to the base 12 along fold lines 18. In this position, the outer side walls 70 should be substantially parallel and adjacent to the wing portions 56 of the back wall 38, with the wing portions 56 positioned proximal to the base 12. The second wing portions 84 of the outer side walls 70 are then folded 180 degrees toward the base 12 along fold lines 86, such that tab 88 on the second wing portion 84 engages the smaller slot 68 along the side edge 18. The inner side walls 72 are then folded 180 degrees toward the base 12 and over the wing portions 56, second wing portions 84, and the outer side walls 70, such that the tabs 76 on the second edge 64 of the side walls 60 engage the slots 66 along the side edges 18. As such, the wing portions 56 of the back wall 38 will be located between the inner side wall 72 and the outer side wall 70. In this manner, the back wall 38 may be vertically secured and the resultant corners reinforced by the interaction between the wing portions 56 of the back wall 38 and the side walls 60. The wing portions 80 are then folded ninety degrees toward the base 12 along fold lines 82.

The front wall is then constructed by folding the front wall 28 along fold line 14 ninety degrees to vertical with respect to the base 12. In this position, the wing portions 80 of the side walls 60 are located parallel and adjacent to the outer front wall 28. The inner front wall 30 is then folded 180 degrees along fold line 32 toward the base 12 and over the wing portions 80 of the side walls 60 and the outer front wall 28, such that tabs 36 on the second edge 24 of the front wall 20 engage the slots 26 along the front edge 14 of the base 12. Thus, the wing portions 80 of the side walls 60 are located between the inner front wall 30 and the outer front wall 28. In this manner, the final two corners of the desk organizer 10 are secured and the four walls securely fixed vertically readily defining the desk organizer 10.

The final steps for constructing the desk organizer 10 involve the assembly and installation of the divider elements 90,120. The first divider element 90 is constructed by folding the third section 96 over the second section 94 along fold line 100. The first section 92 is then folded over the other two sections 94,96 along fold line 92, such that the third section 96 is sandwiched between the first and third sections 92,96. In this configuration, the first slot 110 and the second slot 112 form a single slot through the first divider element 90 that extends approximately one-half the width the combined sections. Similarly, the second divider element 120 is constructed by folding the third section 126 over the second section 124 along fold line 130, and folding the first section 122 over the other two sections 124,126 along fold line 128, such that the third section 126 is sandwiched between the first and second sections 122,126. Again, this configuration aligns the first and second slots 140,142 such that they result in a single slot defined on the second divider element 130.

Once the two divider elements 90,120 are constructed, they are installed in the desk organizer 10. The second divider element 120 is first installed by inserting the wing portions 132,136 into a slot formed by the interaction between the inner side walls 72 and the outer side walls 70. In particular, the angled cut-out 78 of the inner side wall 72 forms a slot or pocket when folded over the outer side wall 70. The second divider element 120 may be secured by inserting the wing portions 132,136 into the formed slot, thus situating the second divider element 120 perpendicular to the base 12 and parallel with the front wall 20. Alternately, the side walls 60 may include pre-defined slots, such as the slot 34 in the front wall 20.

The constructed first divider element 90 is then installed by aligning and inserting the slot formed by slots 110,112 in the first divider element 90 with the slot formed by slots 140,142 in the second divider element 120. The interaction between the two slots fixedly connects the two divider elements 90,120. The wing portions 102,106 are then inserted into slot 34 in the inner front wall 30 and slot 52 in the inner back wall 48 to connect the first divider element 90 to the desktop organizer 10. In this manner, the two divider elements 90,120 provide a sturdy and rigid divider mechanism that allows the desk organizer 10 to offer multiple areas or compartments for storage and organization. Additionally, the overlapping three sections that make up each divider section 90,120 add significantly more integrity to the desk organizer 10 and can handle over 16 lbs of materials being pushed and pulled multiple times per school day.

It should be understood, that the above configuration for the divider elements is exemplary, and that slots within the dividers and/or the walls of the desk organizer 10 may be added, eliminated, moved and/or altered to accommodate any desired number of storage compartments and/or the dimensional configurations of the storage compartments within the desk organizer 10.

The desk organizer 10 may also include a handle disposed along the outer front wall 28. Preferably, the handle is an elongated separate plastic member having a wide section for grasping and an attachment mechanism on either end. The attachment mechanism may be a T-shaped member that may be inserted and secured in a pre-defined slot in the outer front wall 28. It should be understood that any handle that permits young children to easily and securely grasp it to pull or carry the desk organizer 10 would be suitable for use with the desk organizer 10. Additionally, the handle may be utilized by children who have issues with fine motor skills that prevent them from pronating, or turning their hands palm down. The handle allows children to withdraw the desk organizer from the book box of the desk by supinating, turning their hands palm up to grasp the handle.

While the invention has been described in terms of several exemplary embodiments, those skilled in the art will recognize that the invention can be practiced with modification within the spirit and scope of the appended claims.

Further, it is noted that, Applicant's intent is to encompass equivalents of all claim elements, even if amended later during prosecution.

What is claimed is:

1. A foldable cardboard desk organizer comprising:

a base comprising a straight front edge, a straight back edge, and a pair of straight side edges;

a front wall comprising a first edge and a second edge extending in a spaced and parallel relationship to the first edge, wherein the front wall is connected to the base by a fold line along the front edge and the front edge comprises a plurality of linear slots along the front edge, the front wall comprises an outer front wall and an inner front wall, wherein the inner and outer front walls are connected by a fold line that bisects the front wall lengthwise, the inner front wall comprises a slot extending perpendicularly from the second edge and a plurality of tabs extending from the second edge, wherein the tabs engage with the slots along the front edge when the front wall is folded along the fold line;

a back wall comprising a first edge and a second edge extending in a spaced and parallel relationship to the first edge, wherein the back wall is connected to the base by a fold line along the back edge and the back edge comprises a plurality of linear slots along the back edge, the back wall comprises an outer back wall and an inner back wall, wherein the inner and outer back walls are connected by a fold line that bisects the back wall lengthwise, the inner back wall comprises a slot extending perpendicularly from the second edge and a plurality of tabs extending from the second edge, wherein the tabs engage with the slots along the back edge when the back wall is folded along the fold line, the back wall further comprises two wing portions that extend from opposite ends of the outer back wall and are connected to the outer back wall by a fold line;

a pair of side walls, each comprising a first edge and a second edge extending in a spaced and parallel relationship to the first edge, wherein each of the side walls are connected to the base by a fold line along the side edge and the side edge comprises a plurality of linear slots along the side edge, each side wall comprises an outer side wall and an inner side wall, wherein the inner and outer side walls are connected by a fold line that bisects each of the side walls lengthwise, the inner side wall comprises a plurality of tabs extending from the second edge, wherein the tabs engage with the slots along the side edge when the side walls are folded along the fold lines, the outer side walls further comprise a wing portion that extends from the end of the outer side walls adjacent to the front edge, wherein the wing portions are connected to the outer side walls by fold lines;

a first divider section comprising three equal sections, wherein a first section is connected by a fold line with a second section and the second section is connected by a fold line with a third section, the first section and second section each comprises two wing portions extending from opposite ends of the respective section and are connected to the respective sections by fold lines, the first divider section further comprises a first slot that extends from the first section to the second section perpendicular to the fold line and a second slot that extends perpendicularly into the third section from an outer edge of the third section; and a second divider section comprising three equal sections, wherein a first section is connected by a fold line with a second section and the second section is connected by a fold line with a third section, the second section and third section each comprise two wing portions extending from opposite ends of the respective sections and are connected to the respective sections by fold lines, the second divider section further comprises a first slot that extends from the first section to the second section perpendicular to the fold line and a second slot that extends perpendicularly into the third section from an outer edge of the third section.

2. The foldable cardboard desk organizer of claim 1, wherein the base comprises a rectangular shape and is sized to fit within the book box of a standard elementary school desk.

3. The foldable cardboard desk organizer of claim 1, the first edge of the front wall is common with the front edge of the base, the first edge of the back wall is common with the back edge of the base, the first edges of the sidewalls are common with the side edges of the base.

4. The foldable cardboard desk organizer of claim 1, wherein the slot in inner front wall is located at the midpoint of the second edge of the front wall.

5. The foldable cardboard desk organizer of claim 1, wherein the fold lines that connect the two wing portions to the outer back wall are adjacent and collinear with the side edges of the base.

6. The foldable cardboard desk organizer of claim 1, wherein the wing portions connected to the outer back wall have the same width as the outer back wall.

7. The foldable cardboard desk organizer of claim 1, wherein the wing portions connected to the outer back wall start with the same width as the outer back wall and taper slightly.

8. The foldable cardboard desk organizer of claim 1, wherein the second edge of the side walls is shorter than the first edge and terminates before the front edge of the base.

9. The foldable cardboard desk organizer of claim 8, wherein the plurality of linear slots along the side edge include a smaller slot toward the front edge of the base.

10. The foldable cardboard desk organizer of claim 9, wherein the inner side wall further comprises an angled cut-out that initially forms a right angle with the second edge then angles toward the front edge of the base.

11. The foldable cardboard desk organizer of claim 10, wherein the outer side walls further comprise a second wing portion having a pentagonal shape in which a first side of the second wing portion is substantially parallel and adjacent to the wing portion of the outer side wall and an adjacent second side of the second wing portion forms the connection with the outer side wall by a fold line formed at an angle with respect to the side edge.

12. The foldable cardboard desk organizer of claim 11, wherein an adjacent third side of the second wing portion comprises a tab, wherein when the second wing portion is folded along the fold line the tab engages the smaller slot along the side edge of the base.

13. The foldable cardboard desk organizer of claim 1, wherein the fold lines that connect the wing portions to the outer side walls are adjacent and collinear with the front edge of the base.

14. The foldable cardboard desk organizer of claim 1, wherein the wing portions connected to the outer side walls have a width that is less than or equal to the width of the outer front wall of the front wall.

15. The foldable cardboard desk organizer of claim 1, wherein each of the sections of the first divider section have a length equal to the length of the side walls and a width equal to the width of the outer front wall, and each of the sections of the second divider section have a length equal to the length of the front and back walls and a width equal to the width of the outer front wall.

16. The foldable cardboard desk organizer of claim 1, wherein the first slot in the first divider section has a length equal the width of the first section and extends equally into either section with the fold line between the first and second sections defining the midpoint of the first slot.

17. The foldable cardboard desk organizer of claim 1, wherein the first slot and the second slot of the first divider section are collinear and situated are equidistant from the fold lines connecting the wing portions.

18. The foldable cardboard desk organizer of claim 1, wherein the first slot in the second divider section has a length equal the width of the first section and extends equally into either section with the fold line between the second and third sections defining the midpoint of the first slot.

19. The foldable cardboard desk organizer of claim 1, wherein the first slot and the second slot of the second divider section are collinear and situated are equidistant from the fold lines connecting the wing portions.

20. The foldable cardboard desk organizer of claim 1, wherein the slot on the front wall and the slot on the front wall are sized to receive the wing portions of the first and second sections of the second divider.

* * * * *